US007089945B1

(12) United States Patent
Barge

(10) Patent No.: US 7,089,945 B1
(45) Date of Patent: Aug. 15, 2006

(54) TELESCOPING COMB FOR LICE REMOVAL

(76) Inventor: Stanley D. Barge, 3083 S. Congress Rd., Camden, NJ (US) 08104

( * ) Notice: Subject to any disclaimer, the term of this patent is extended or adjusted under 35 U.S.C. 154(b) by 119 days.

(21) Appl. No.: 10/840,447

(22) Filed: May 7, 2004

(51) Int. Cl.
*A45D 24/04* (2006.01)

(52) U.S. Cl. ..... 132/129; 132/138; 132/139; 132/157; 119/627

(58) Field of Classification Search ..... 132/333, 132/139, 144, 128, 138, 157, 216, 129; 119/625–627, 119/63
See application file for complete search history.

(56) References Cited

U.S. PATENT DOCUMENTS

| | | | | |
|---|---|---|---|---|
| 1,853,828 | A * | 4/1932 | Mani | 132/132 |
| 2,577,991 | A * | 12/1951 | Zurndorfer | 132/123 |
| 2,915,071 | A * | 12/1959 | Watkins | 132/213.1 |
| 4,289,153 | A * | 9/1981 | Paccione | 132/313 |
| 4,612,944 | A | 9/1986 | Bachrach et al. | |
| 4,612,945 | A | 9/1986 | Bachrach | |
| D289,567 | S | 4/1987 | O'Connor et al. | |
| 4,807,652 | A | 2/1989 | Bachrach | |
| 4,819,670 | A | 4/1989 | Saferstein et al. | |
| D307,192 | S | 4/1990 | Saferstein et al. | |
| 5,261,427 | A | 11/1993 | Dolev | |
| D353,915 | S | 12/1994 | Lanne | |
| D415,595 | S | 10/1999 | O'Farrell et al. | |
| 6,006,758 | A | 12/1999 | Thorne | |
| 6,754,929 | B1 * | 6/2004 | Fichter | 15/114 |
| 2005/0051190 | A1 * | 3/2005 | Bachrach et al. | 132/333 |

* cited by examiner

*Primary Examiner*—Kevin Shaver
*Assistant Examiner*—Stephanie L. Willatt
(74) *Attorney, Agent, or Firm*—John D. Guekiotta

(57) ABSTRACT

A telescoping comb for lice removal is provided for removing head lice and nits from a person's hair. The comb has a telescoping handle with serrated teeth and a pivoting handle. Resilient springs are utilized for holding the pivoting handle in an open position and holding a head portion of the telescoping handle in a closed position in the resting state. Pressure applied to the pivoting handle actuates the head portion to an open position, and upon subsequent release thereof, the head portion is spring biased back to the closed position. When the invention is used on one's hair, the teeth of the comb separate any lice from the hair where they can be safely removed.

6 Claims, 4 Drawing Sheets

TELESCOPING COMB FOR LICE REMOVAL

BACKGROUND OF THE INVENTION

1. Field of the Invention

The present invention relates generally to the field of combs and, more particularly, to a telescoping comb for lice removal.

2. Description of the Related Art

The effective elimination of head lice requires radical eradication. If you kill 99.99% of the lice, for example, but leave 0.01% alive and kicking, you have the makings of yet another unfortunate infestation. In order to achieve control, you must kill the active adults and remove all of the nits. According to many parasitologists and lice experts, the manual or mechanical removal of lice and nits from the hair is crucial no matter what treatment regimen is chosen. The preferred method of mechanical removal is that of using a lice comb. However, conventional lice combs are little more than combs with tightly space teeth, and do not compensate for an individual's specific type of hair.

Accordingly, there is a need for a means by which head lice can be removed from a persons' hair in a simple, safe and effective manner without regard to specific hair styles or textures. The development of the telescoping comb for lice removal fulfills this need.

A search of the prior art did not disclose any patents that read directly on the claims of the instant invention; however, the following references were considered related. The following patents disclose a method and comb for the detection and removal of head lice: U.S. Pat. No. 6,006,758 issued in the name of Thorne; and U.S. Pat. No. 5,261,427 issued in the name of Dolev.

The following patents describe the design and function of an adjustable lice comb: U.S. Pat. No. 4,819,670 issued in the name of Saferstein et al.; and U.S. Pat. No. D 307,192 issued in the name of Saferstein et al.

The following patents disclose the design and function of a delousing comb: U.S. Pat. No. 4,807,652 issued in the name of Bachrach; U.S. Pat. No. 4,612,945 issued in the name of Bachrach; U.S. Pat. No. 4,612,944 issued in the name of Bachrach et al.; U.S. Pat. No. D 353,915 issued in the name of Lanne; and U.S. Pat. No. D 289,567 issued in the name of O'Connor et al.

U.S. Pat. No. D 415,595 issued in the name of O'Farrell et al. describes the ornamental design for an insect and insect egg removal device.

Consequently, a need has been felt for providing a device by which head lice can be removed from a persons' hair in a simple, safe and effective manner without regard to specific hair styles or textures.

SUMMARY OF THE INVENTION

Therefore, it is an object of the present invention to provide a head lice removal device which allows for complete removal of lice and which reduces chances of re-infestation.

It is another object of the present invention to provide a head lice removal device which helps control diseases.

It is still another object of the present invention to provide a head lice removal device which can be used anywhere and is safe to use.

It is another object of the present invention to provide a head lice removal comb which is equipped with serrated teeth.

It is another object of the present invention to provide a head lice removal comb which provides for secure grabbing of lice.

It is another object of the present invention to provide a head lice removal comb which is easy to hold and use.

It is another object of the present invention to provide a head lice removal comb which utilizes springs for holding the head portion of the comb in a closed position.

It is another object of the present invention to provide a head lice removal comb which can be used on both short and long hair.

Briefly described according to one embodiment of the present invention, a telescoping comb for lice removal is provided for removing head lice and nits from a person's hair.

The device comprises a telescoping handle with serrated teeth and a pivoting handle. Resilient springs are utilized for holding the pivoting handle in an open position and holding a head portion of the telescoping handle in a closed position in the resting state. Pressure applied to the pivoting handle actuates the head portion to an open position, and upon subsequent release thereof, the head portion is spring biased back to the closed position. When the invention is used on one's hair, the teeth of the comb separate any lice from the hair where they can be safely removed.

The use of the present invention allows for complete removal of lice from a victim's hair in a quick, easy, effective and safe manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
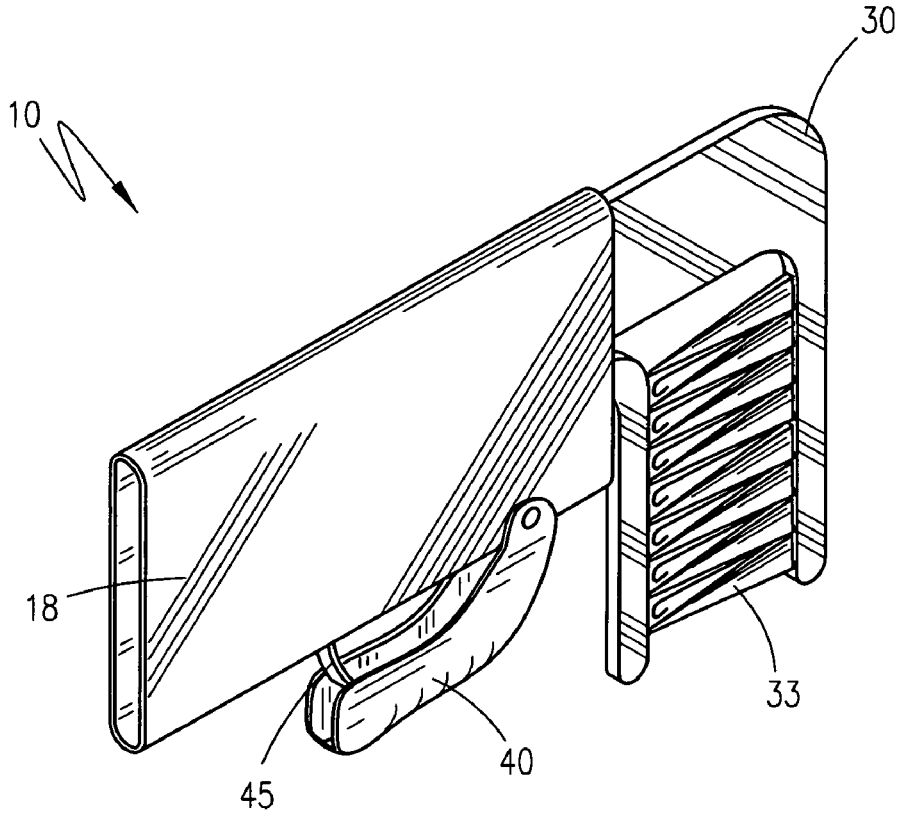
FIG. 1 is a perspective view of a telescoping comb for lice removal according to the preferred embodiment of the present invention.
Figure 2:
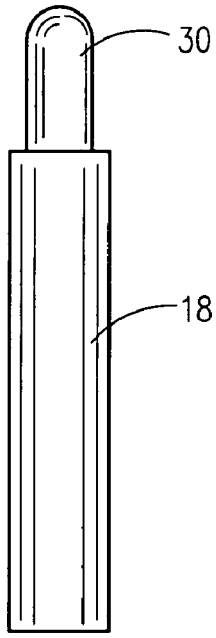
FIG. 2 is a top plan view thereof.
Figure 3:
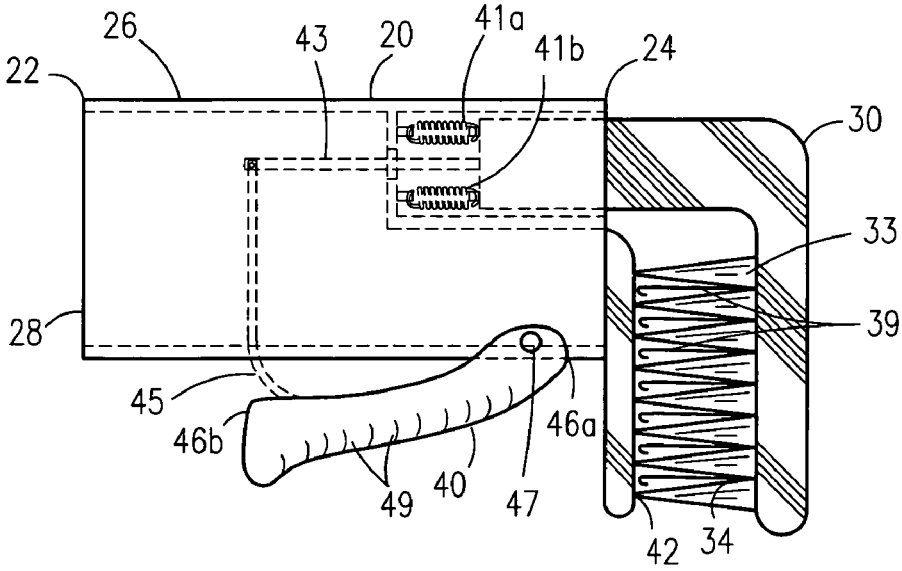
FIG. 3 is a side elevational view of the present invention shown with the pivoting handle in an open position and with the protective casing removed according to the preferred embodiment.

Referring now to FIGS. 1–5, a telescoping comb for lice removal 10 is shown, according to the present invention, comprised of a comb casing 18, a linearly elongated, cylindrical telescoping handle 20, an L-shaped head portion 30, and a pivoting handle 40. The telescoping comb for lice removal 10 is fabricated of a plastic material such as polyurethane or polypropylene or other plastic material capable of injection molding, and therefore can be formed easily of recycled material. It is envisioned that the telescoping comb for lice removal 10 is colored so as to make lice and nits conspicuous when adhered thereto.

The comb casing 18 is of a linearly elongated, hollow, C-shaped configuration which provides a protective cover for components encased therein.

Referring now to FIGS. 1–4, the handle 20 has an anterior end 22 opposite a posterior end 24. The handle 20 further includes a linearly elongated, cylindrical, hollow first handle portion 26 positioned above a second handle portion 28. The first handle portion 26 is designed and configured so as to telescopically receive an L-shaped head portion 30. A plurality of linearly aligned, closely-spaced serrated teeth 33 extend vertically away from a base 34 of the L-shaped head portion 30. The spacing between the teeth 33 is defined as having elongated, serrated edge teeth 39 mounted to the base 34 which extend vertically therefrom for aiding in the removal of both lice and nits in the hair and on the scalp. The serrated edges 39 are designed and configured to aid in the capture of both lice and nits as the teeth 33 of the head portion 30 glide through one's hair and scalp. Both the teeth 33 and the serrations 39 in conjunction facilitate the adherence of lice and nits thereto when combing through one's hair when using the present invention.

The head portion 30 is held in a retracted, resting position within the first handle portion 26 by a pair of retention springs 41*a*, 41*b* wherein each spring 41*a*, 41*b* is mounted at one end to an end of the head portion 30 opposite the base 34, and mounted at an opposite end to an internal circumferential surface of the first handle portion 26. While in the resting position, pointed ends of the teeth 33 rest against a base 42 (to be described in greater detail below) of the second handle portion 28.

The second handle portion 28 is of a generally, linearly elongated, cylindrical hollow configuration which has an elongated void 29 (shown in FIG. 5) formed on an underside thereof for allowing inward and outward passage of a pivoting handle 40 (to be described in greater detail below). The second handle portion 28 includes a base 42 formed at the posterior end 24 thereof.

An elongated drive arm 43 is mounted between the retention springs 41*a*, 41*b* at the end of the head portion 30 opposite the base 34. A C-shaped pivot arm 45 is pivotally attached at one end to an end of the drive arm 43, and is mounted at an opposite end to an upper surface of the pivoting handle 40 near a posterior end 46*b* thereof. The pivoting handle 40 is pivotally attached at an anterior end 46*a* thereof to the second handle portion 28 via a pivot pin 47 which includes a spring 48 disposed therearound biased such that the pivoting handle 40 rests in an open position. The pivoting handle 40 is further defined as having a plurality of finger-gripping channels 49 formed along a lower surface thereof to allow a user to obtain both a firm and comfortable grasp of the pivoting handle 40 when squeezing it to a closed position, as shown in FIG. 4.

Figure 4:
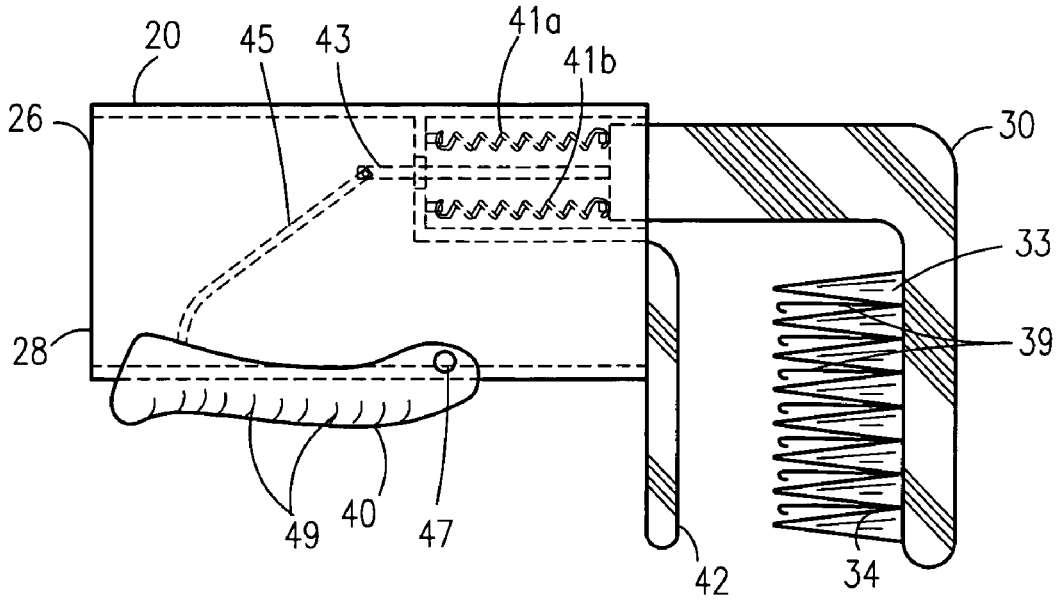
FIG. 4 is a side elevational view of the present invention shown with the pivoting handle in a closed position and with the protective cover removed according to the preferred embodiment.
Figure 5:
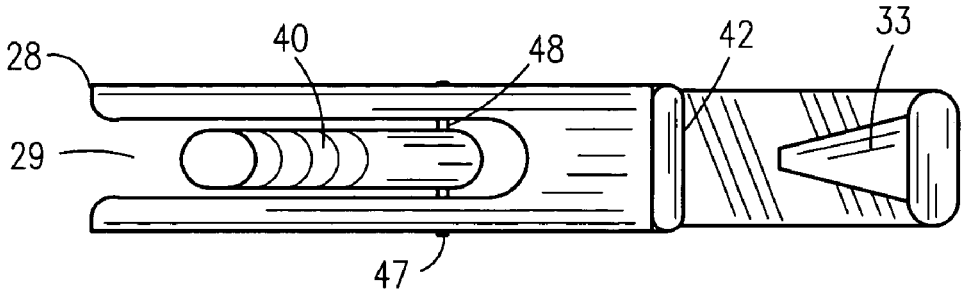
FIG. 5 is a bottom plan view of the present invention according to the preferred embodiment.

Referring now specifically to FIG. 4, the telescoping comb for lice removal 10 is designed and configured such that when a user squeezes the pivoting handle 40 to a closed position, such action actuates upward movement by the C-shaped pivot arm 45, and being pivotally connected to the drive arm 43, thus actuates the drive arm 43 to drive the head portion 30 outside of the first handle portion 26 to an open position.

Upon release of the pivoting handle 40, both the pivoting handle 40 and the head portion 30 are spring-biased to a closed position via springs 41*a*, 41*b*, 48.

When using the present invention, the objective is to ensure the entire scalp and hair is combed so as to effectively remove all lice and nits. First, the user squeezes the pivoting handle 40 to a closed position, thereby actuating the head portion 30 to an open position. Next, the user places the pointed ends of the teeth 33, while making sure hair is trapped therebetween, next to the scalp, releases the pivoting handle 40, and combs the entire length of the hair in one gliding motion. After each passage of the telescoping comb for lice removal 10 through the hair, it should be rinsed with running hot water so as to effectively remove captured lice and nits adhered thereto. This combing process starts in one section of the head and progresses systematically over the entire scalp. The above stated process should be repeated daily for approximately one to two weeks or until lice and nits are no longer present.

Figure 6A:
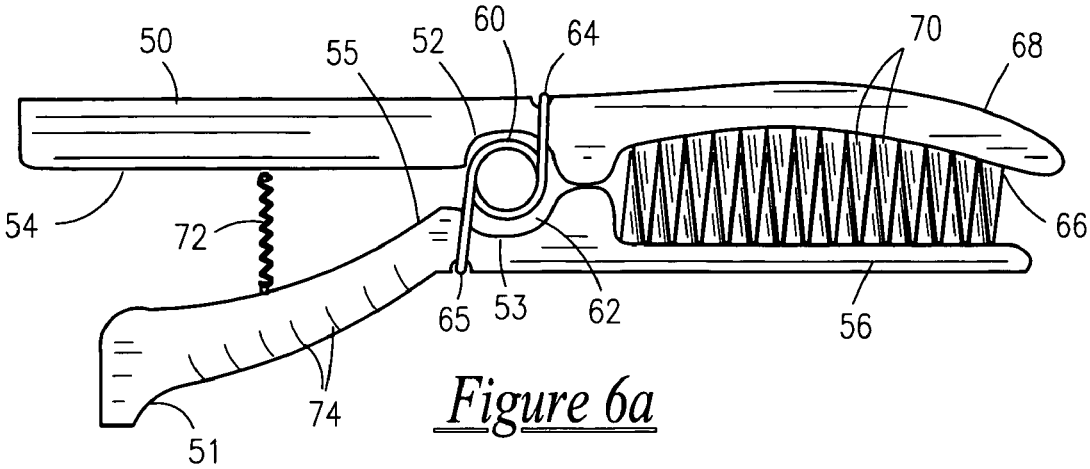
FIGS. 6*a*–6*c* show an alternate embodiment of the present invention.
Figure 6B:
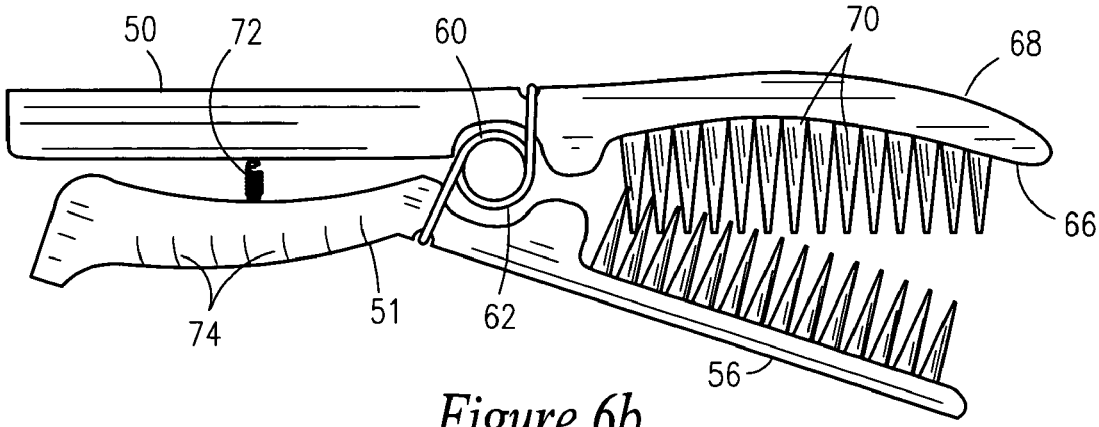
Figure 6C:
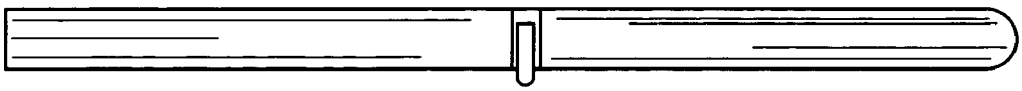

Referring now to FIGS. 6*a*–6*c*, an alternate embodiment of the present invention is shown for use with persons having hair of extraordinary length, such as hair extending below shoulder length.

The alternate embodiment comprises a pair of elongated handle members 50, 51 coupled by a resilient spring 60 along a linearly elongated centerline of each.

Each handle member 50, 51 includes a cavity 52, 53 formed on an inner surface thereof, thereby forming a circular hole 62 wherein the resilient spring 60 rests. The resilient spring 60 is further defined as having ends 64, 65 disposed within handle members 50, 51 respectively.

Handle member 50 includes a plurality of linearly aligned, closely-spaced, serrated teeth 70 extending vertically away from a base 66 of a head portion 68 of handle member 50.

The resilient spring 60 is biased such that handle members 50, 51 rest in an open position, and the head portion 68 of handle member 50 rests in a closed position, wherein the teeth 69 thereof rest against an upper surface of a forward portion 56 of handle member 51, as shown in FIG. 6A.

Spring 72 is disposed between handle members 50, 51 for aiding in biasing the handle members 50, 51 to an open position.

Handle member 51 is further defined as having a plurality of finger-gripping channels 74 formed along a lower surface thereof to allow a user to obtain a firm and comfortable grasp of the handle members 50, 51 when squeezing them to a closed position.

The alternate embodiment is designed and configured such that when a user squeezes handle members 50, 51 to a closed position, such action, via the resilient spring 60, spring biases the head portion 68 of handle member 50 and the forward portion 56 of handle member 51 to an open position.

When using the alternate embodiment of the present invention, the objective is to ensure the entire scalp and hair is combed so as to effectively remove all lice and nits. First, the user squeezes handle members 50, 51 to a closed position, thereby actuating the head portion 68 of handle member 50 to an open position. Next, the user places the pointed ends of the teeth 70, while making sure hair is trapped therebetween, next to the scalp, releases handle members 50, 51, and combs the entire length of the hair in one gliding motion. After each passage of the alternate embodiment through the hair, it should be rinsed with running hot water so as to effectively remove captured lice and nits adhered thereto. This combing process starts in one section of the head and progresses systematically over the entire scalp. The above stated process should be repeated daily for approximately one to two weeks or until lice and nits are no longer present.

2. Operation of the Preferred Embodiment

To use the present invention, first, the user squeezes the pivoting handle 40 to a closed position, thereby actuating the head portion 30 to an open position. Next, the user places the pointed ends of the teeth 33, while making sure hair is trapped therebetween, next to the scalp, releases the pivoting handle 40, and combs the entire length of the hair in one gliding motion. After each passage of the telescoping comb for lice removal 10 through the hair, it should be rinsed with running hot water so as to effectively remove captured lice and nits adhered thereto. This combing process starts in one section of the head and progresses systematically over the entire scalp. The above stated process should be repeated daily for approximately one to two weeks or until lice and nits are no longer present.

The use of the present invention allows for complete removal of lice from a victim's hair in a quick, easy, effective and safe manner.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A telescoping comb for lice removal comprising:

a comb casing formed of a linearly elongated, telescoping handle and an L-shaped head portion;

said handle having an anterior end opposite a posterior end and further includes a linearly elongated, hollow first handle portion positioned above a second handle portion, said first handle portion designed and configured so as to telescopically receive an L-shaped head portion;

a plurality of linearly aligned, closely-spaced serrated teeth extend vertically away from a base of said L-shaped head portion, each said spacing between said teeth defined as having elongated, J-shaped hook mounted to the base which extend vertically therefrom for aiding in the removal of both lice and nits in the hair and on the scalp;

wherein said teeth are designed and configured to aid in the capture of both lice and nits as the teeth glide through one's hair and scalp, and wherein said head portion is held in a retracted, resting position within the first handle portion by a pair of retention springs wherein each said spring is mounted at one end to an end of the head portion opposite the base, and mounted at an opposite end to the first handle portion.

2. The telescoping comb for lice removal of claim 1, wherein said second handle portion is of a generally, linearly elongated, hollow configuration which has an elongated void formed on an underside thereof for allowing inward and outward passage of a pivoting handle.

3. The telescoping comb for lice removal of claim 2, wherein said second handle portion includes a base formed at the posterior end thereof.

4. The telescoping comb for lice removal of claim 2, further comprising an elongated drive arm mounted between the retention springs at the end of the head portion opposite the base.

5. The telescoping comb for lice removal of claim 4, wherein said elongated drive arm comprises a C-shaped pivot arm pivotally attached at one end to an end of said drive arm and is mounted at an opposite end to an upper surface of the pivoting handle near a posterior end thereof, wherein said pivoting handle is pivotally attached at an anterior end thereof to the second handle portion via a pivot pin which includes a spring disposed therearound biased such that the pivoting handle rests in an open position.

6. The telescoping comb for lice removal of claim 5, wherein said pivoting handle is further defined as having a plurality of finger-gripping channels formed along a lower surface thereof to allow a user to obtain both a firm and comfortable grasp of the pivoting handle when squeezing it to a closed position.

* * * * *